United States Patent [19]

Sontheimer

[11] Patent Number: 4,647,727

[45] Date of Patent: Mar. 3, 1987

[54] SWITCH FOR AUTOMATICALLY INTERRUPTING A CIRCUIT WHEN ITS CONTACTS ARE FUSED TOGETHER IN THE "ON" POSITION

[75] Inventor: Carl G. Sontheimer, Greenwich, Conn.

[73] Assignee: Cuisinarts, Inc., Greenwich, Conn.

[21] Appl. No.: 719,684

[22] Filed: Apr. 4, 1985

[51] Int. Cl.[4] ..... H01H 9/00

[52] U.S. Cl. ..... 200/1 R; 200/153 T; 200/DIG. 42; 307/326

[58] Field of Search ..... 361/189; 307/116, 117, 307/326; 200/146, 153 T, 1 V, DIG. 42, 1 R

[56] References Cited

U.S. PATENT DOCUMENTS

| | | | |
|---|---|---|---|
| 3,809,837 | 5/1974 | Yoshioka | 200/153 T |
| 3,964,004 | 6/1976 | Mertler | 200/DIG. 42 |
| 4,105,882 | 8/1978 | Ulbing | 200/242 |

*Primary Examiner*—G. P. Tolin
*Assistant Examiner*—Morris Ginsburg
*Attorney, Agent, or Firm*—Parmelee, Bollinger & Bramblett

[57] ABSTRACT

A safety switch for automatically interrupting a circuit when its main contacts are fused or stuck together in the "ON" position comprises a housing containing a pair of main contacts and auxiliary safety contacts which are normally closed but are automatically opened when the main contacts fuse together. One main contact is an "ON" contact, and the other main contact is carried by a movable switch arm. A first spring in the housing mechanically coupled to the movable switch arm normally urges the movable main contact into open position away from the engagement with the ON contact. Switch operating means include a movable actuator to overcome the biasing force of the spring for moving the movable main contact to closed position into engagement with the ON main contact for energizing a circuit controlled by the main contacts. The auxiliary safety contacts become opened in response to abnormal movement of the switch arm under influence of the spring when the actuator is moved to OFF position, but the movable main contact remains fused or stuck to the ON main contact. In their operation, a second pre-stressed spring continuously biases the auxiliary safety contacts toward open position, and they are automatically triggered and immediately are moved from closed to open position by this pre-stressed spring for interrupting the controlled circuit when the actuator is moved to Off position but the main contacts remain fused or stuck together in ON relationship.

11 Claims, 7 Drawing Figures

SWITCH FOR AUTOMATICALLY INTERRUPTING A CIRCUIT WHEN ITS CONTACTS ARE FUSED TOGETHER IN THE "ON" POSITION

BACKGROUND OF THE INVENTION

The present invention relates to control switches, and more particularly to a safety switch with auxiliary contacts in the switch for automatically interrupting a circuit controlled by the switch when the main contacts remain fused or stuck together in the "ON" position as the switch actuator is moved to the "OFF" position.

During the operation of electrical equipment, occasions can arise in which the contacts of a control switch, e.g., a microswitch, become fused, welded or stuck together in their ON position. This fused condition can occur under heavy load when increased current is being drawn at the instant when the switch is turned OFF, with the result that there is arcing across the ON contacts and, therefore, fusing or welding of the contacts causing them to remain in their closed position, even though the switch operating means has been moved to OFF position.

For example, a control switch may be used to operate alternating current electrical equipment including a motor. If the switch actuator happens to be moved to the OFF position at an instant during a cycle of the alternating current when peak current is flowing in a heavily loaded motor, severe arcing with consequent welding can occur as the contacts start to part, due to the energy stored in the magentic field of the motor which momentarily tends to maintain a large current flow through the contacts as they start to separate. Therefore, the contacts remain fused together in their ON condition, after the switch operating means has been turned OFF.

With a switch in this fused or "welded" condition, the circuit to the electrical equipment is still capable of energizing the equipment. For example, the switch may be a control or safety switch included in the interlock mechanism associated with rotatable motor-driven electrical equipment for deenergizing the equipment when the operator opens a cover or a door intending to seek access to rotatable parts of equipment. This welded condition of the main contacts in the switch of an interlock mechanism is quite dangerous to the operator of the equipment, since the operator knows that there is an interlock mechanism which normally opens (deactivates) the electrical circuit to the equipment whenever the operator opens the cover or door. Moreover, if the operator visually checks the interlock mechanism, it is seen to be in its open circuit position. The operator is lulled into a false sense of security when a switch inadvertently remains closed in an interlock arrangement. The operator may then proceed to perform maintenance or cleaning of the equipment or to change tools in the equipment, assuming that the equipment cannot be activated. In the course of such service the operator or someone else may accidentally engage a nearby operating switch. The circuit to the equipment is then completed because the interlock switch has malfunctioned, and the equipment then proceeds to operate, with possible consequential damage to the equipment or injury to the operator. Moreover, if the equipment has been partially disassembled for maintenance, and then is activated, considerable damage may occur.

The terms "fused", "welded" or "stuck" are used herein interchangeably in a generic sense to mean that the main contacts of a switch are remaining together touching or joining each other in a current-conducting relationship, when these main contacts are intended to be separated from each other in a non-conducting relationship by moving the switch operating means to the OFF position.

SUMMARY OF THE INVENTION

It is an object of the present invention to provide a switch which automatically interrupts a circuit when its, main contacts inadvertently remain fused, welded or stuck together, after the switch actuator has been moved to OFF position.

It is an object of the present invention to provide a switch having normally closed auxiliary contacts in the switch which are automatically opened if the main contacts of the switch have been fused, welded or stuck together in their ON position, when the switch actuator is moved to the OFF position.

It is an object of the present invention to provide auxiliary contact means in a switch for use in interlock mechanism which automatically become moved from closed to open position if the switch is turned OFF but its main contacts remain in their ON position.

An object of this invention is to provide a safety switch having spring-biased auxiliary safety contact means which become triggered and released from a closed position to an open position for interrupting a circuit, when the switch operating means are moved to OFF position but the main contacts of the switch remain together in their ON position.

Among the advantages of the present invention are those resulting from safety apparatus adapted to be incorporated within a switch housing. This safety apparatus includes auxiliary contacts which are normally in a closed relationship and are automatically moved to an open relationship for interrupting a circuit in the event the main switch contacts remain together in their closed or ON position after the switch operating means have been moved to the OFF position.

It is a further object of the present invention to provide a switch for use in interlock mechanism and having auxiliary safety contacts for automatically deactivating a circuit controlled by the switch to prevent energization of equipment in the circuit when the main switch contacts remain together in their ON condition, after the interlock mechanism has been operated in such manner as normally would cause the switch to be turned OFF.

The present invention provides switch apparatus well adapted for use in an interlock mechanism which advantageously protects the operator of driven electrical equipment from accidental injury when the contacts of the switch remain together in their ON position, after the interlock mechanism has been used with the intention of causing the switch contacts to be moved to their OFF position.

The present invention in certain of its aspects provides a safety switch wherein main contacts of the switch are closed for completing a circuit and are opened for interrupting the circuit, said safety switch comprising: normally closed auxiliary contacts located within the switch housing, and means for causing said auxiliary contacts to open if the main contacts remain closed when the switch is actuated for opening the main contacts.

Briefly, in accordance with the present invention in certain of its embodiments, a switch including a housing has a common terminal and an ON terminal each extending to the exterior of the housing, the ON terminal having an ON contact located within the housing; a movable switch arm in the housing carries contact means movable between open and closed positions; spring means in the housing urge the switch arm to open position; a movable actuator accessible from the exterior of the housing is operatively associated with the switch arm for moving the arm from open to closed ("ON") position for causing the contact means carried by the switch arm to touch the ON contact, the actuator when released allowing the spring means to return the switch arm from closed to open position; electrically conductive means in the housing complete a conductive path between the common terminal and the movable contact means for completing an electrically conductive path to the ON terminal when the switch arm is in closed position, the switch housing including: auxiliary switch means capable of automatically interrupting a circuit in the event the movable contact becomes welded to the ON contact, when the movable actuator has been released and the spring means attempts to return the movable switch arm to its open position.

In accordance with the present invention in certain of its aspects, safety apparatus is provided in a switch having first and second main contacts, switch operating means movable in a first direction for causing said main contacts to touch each other for turning the switch ON, said switch operating means being movable in a second direction for causing said main contacts to separate for turning the switch OFF, such safety apparatus in the switch comprises: first and second auxiliary contact means, a movable member operatively associated with said first and second auxiliary contact means and with said switch operating means, said first auxiliary contact means normally being held by said movable member against said second auxiliary contact means, spring bias for urging said movable member to move said first auxiliary contact means away from said second auxiliary contact means for interrupting a current path, said movable member normally being restrained against said spring bias by said switch operating mean, and said movable member being released to respond to said spring bias in the event that said switch operating means is moved in said second direction but said main contacts do not become separated and thus the switch is actually not OFF, thus releasing said movable member to be moved by said spring bias for moving said first auxiliary contact means away from said second auxiliary contact means for interrupting the current path.

In accordance with the present invention in certain aspects, the safety apparatus provided in such a switch comprises: first and second auxiliary contact means, the first auxiliary contact means normally touching the second auxiliary contact means the first auxiliary contact means being movable away from the second auxiliary contact means for interrupting a circuit, and a movable member operatively associated with said switch operating means for moving said first auxiliary contact means away from said second auxiliary contact means for interrupting the circuit in the event that the switch operating means is moved into position for separating the main contacts of the swtich, i.e., for turning the switch OFF, but the main contacts actually do not become separated.

Other objects, aspects and advantages of the present invention will be understood from the following detailed description considered in conjunction with the drawings, which are presented herein and should be construed in an illustrative but not in a limiting sense, as follows:

DETAILED DESCRIPTION

It has been a long standing problem that switch contacts can occasionally unexpectedly become welded or fused or stuck together in their ON or closed circuit condition, when appropriate steps have been taken by an operator or by control mechanism, for example such as by an interlock mechanism, which are intended to turn OFF the switch, i.e., to open a circuit controlled by the switch. The present invention has solved this problem in a practical, compact and feasible manner.

Figure 1:
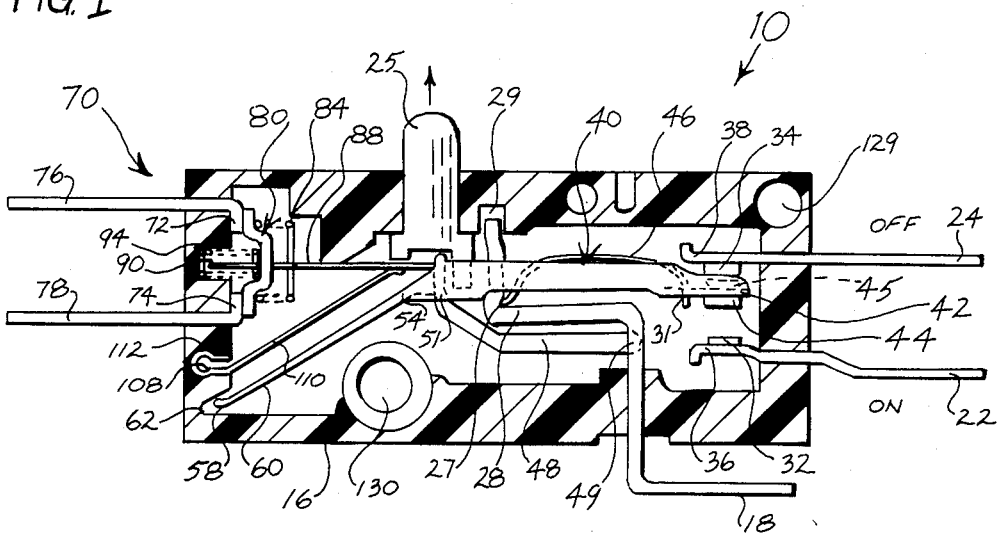
FIG. 1 is an enlarged side elevational view of a switch embodying the invention, with the housing of the switch being shown cut away in section and the switch shown in its OFF position. Auxiliary safety contact means within the switch housing are normally held closed for completing a circuit, for example, such as shown in FIG. 7.
Figure 7:
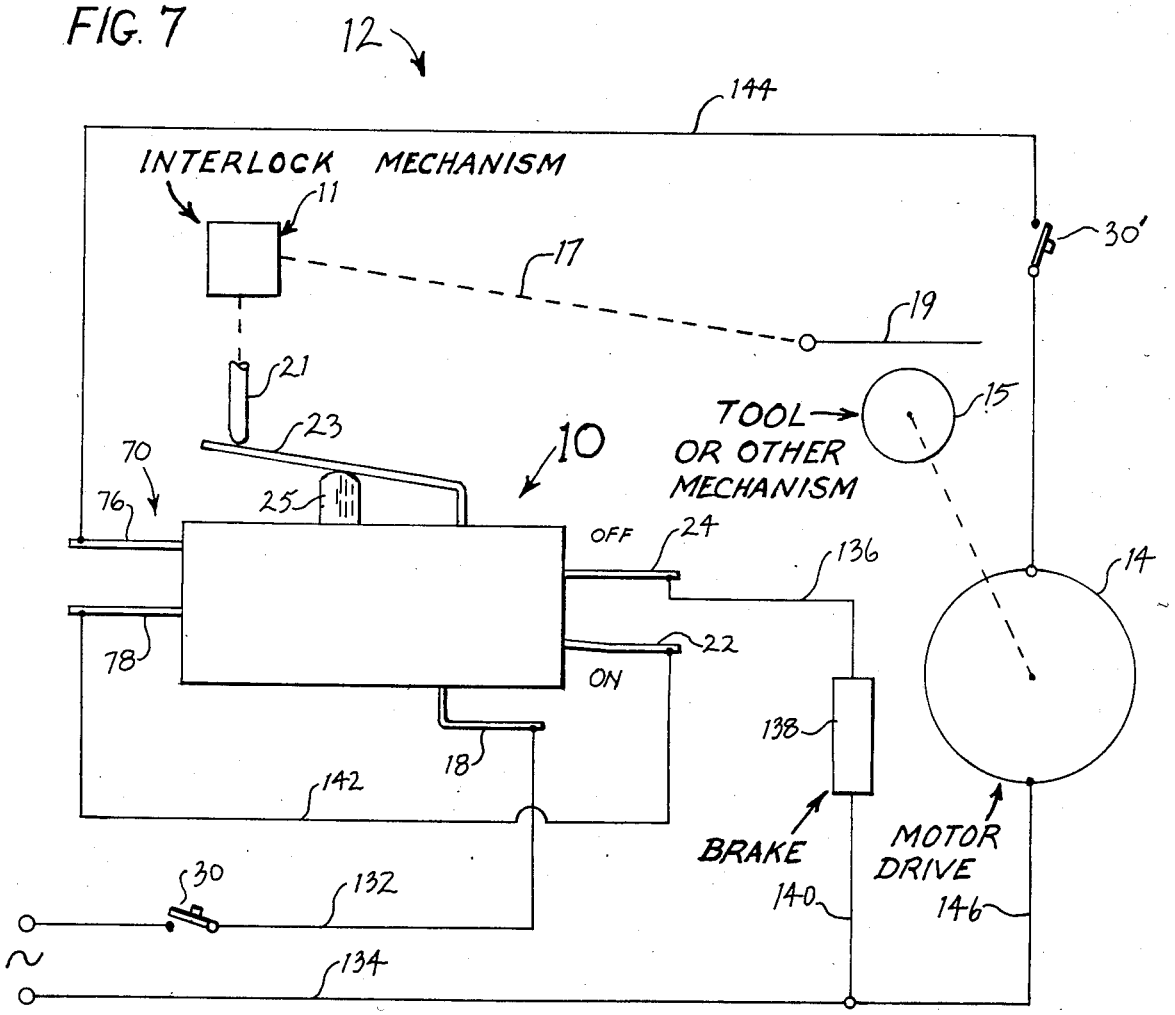
FIG. 7 shows the switch of FIGS. 1 through 5 connected in a circuit including electrical equipment which is controlled by this switch.

Referring to FIG. 1, a safety switch embodying the present invention is illustrated generally at 10. This switch 10 is shown by way of example as a control switch used with an interlock mechanism 11 (FIG. 7) for opening and closing a circuit 12, for example as shown in FIG. 7, which energizes electrical equipment 14, for example such as an electric motor drive for driving a tool or other machinery 15.

This interlock mechanism 11 is illustratively shown associated as indicated by the dashed line 17 with a cover or door 19 which blocks access to the tool or machinery 15, until this access barrier 19 is opened. The interlock mechanism includes a plunger 21 which depresses a switch operating lever 23 and an actuator 25 for keeping the switch 10 in its ON condition, so long as the access barrier 19 is closed. When the operator opens the barrier 19 to obtain access to the tool or machinery 15, the interlock mechanism 11 causes the plunger 21 to be raised, thus allowing the actuator 25 to move upwardly as explained later for turning OFF the switch 10 for preventing the motor drive 14 from becoming energized.

The switch 10 includes an insulating housing 16 having a common terminal 18 fixed relative to the housing 16 and extending externally from the housing. A pair of spaced ON and OFF terminals 22 and 24 are also fixed relative to the housing 16 and extend externally therefrom.

The ON terminal 22 has an ON contact 32 fastened to its internal end 36 located within the housing 16. Similarly, the OFF terminal 24 has an OFF contact 34 fastened to its internal end 38 located within the housing 16. The ON contact 32 and OFF contact 34 are spaced relative to one another to receive the end of a movable switch arm 40 between them. Specifically, the first end 42 of the movable switch arm 40 is interposed between the ON contact 32 and the OFF contact 34.

Figure 2:
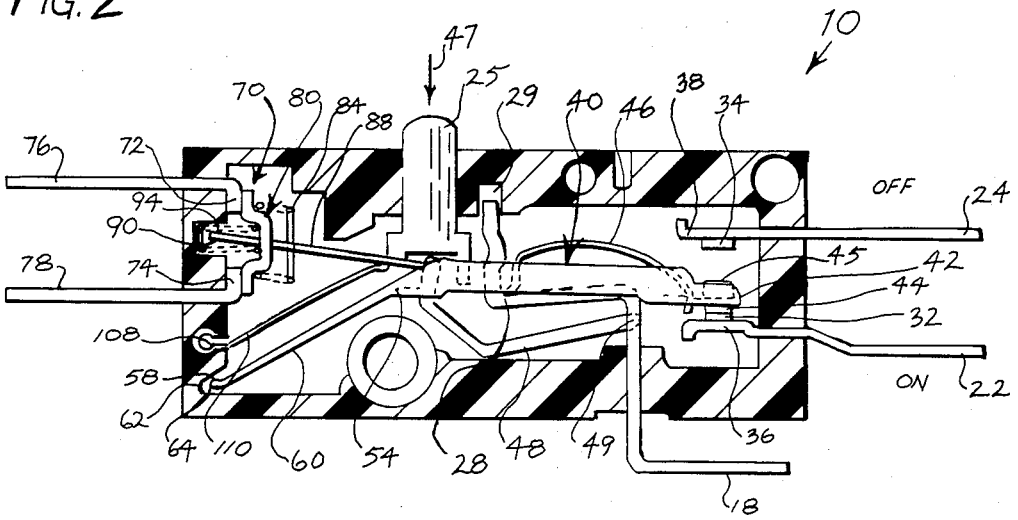
FIG. 2 is an enlarged side elevational view of the switch of FIG. 1, showing its ON position.
Figure 3:
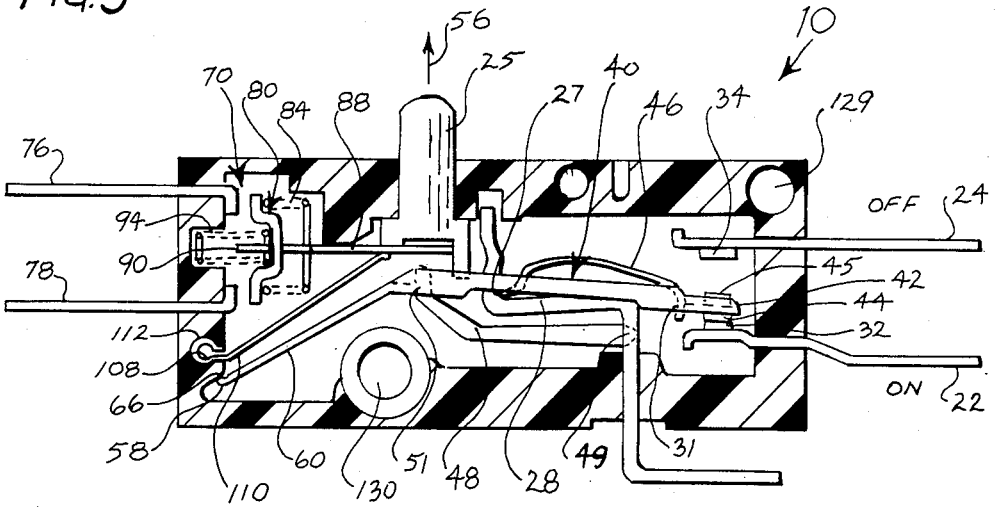
FIG. 3 is an enlarged side elevational view of the switch of FIG. 1, with the main contacts of the switch "welded" together in their ON position, after the switch operating means has been moved to OFF position. Consequently, the auxiliary safety contact means within the switch have automatically been released immediate to open for interrupting the circuit.

Affixed to this first end 42 of the movable switch arm 40 is a contact 44 which moves with the arm between an ON position of engagement with, i.e., touching the ON contact 32 (FIG. 2) to an OFF position of separation from this ON contact (FIG. 1). Also shown affixed to this first end 42 of the switch arm is another contact 45 which moves with the arm. When the switch arm is in its OFF position, as shown in FIG. 1, the movable contact 45 is in engagement with (touches) the OFF contact 34. The movable switch arm 40 is biased upwardly by a bow spring 46, so that the movable contact 45 normally engages the OFF contact 34. This spring 46 is mechanically coupled to the movable switch arm 40 and thrusts at a location 27 against the stationary internal end 28 of the common terminal 18 for providing a bias force urging the switch arm 40 toward the OFF position. This inner end portion 28 of the common terminal is anchored in a recess 29 in the wall of the switch housing, and there is a notch or concave bend at the location 7 for receiving the end of the bow spring 46. The other end of the bow spring hooks at 31 into a slot in the switch arm 40. If desired, the switch operating lever 23 may be omitted from the switch 10 as is shown in FIGS. 1–3, in which case the plunger 21 is directly aligned over the actuator 25 for depressing it. Although this switch actuator 25 is illustratively shown to be moved by an interlock mechanism, it is to be understood that this actuator may be moved down or depressed by external operation of the switch in a variety of ways, such as manually or mechanically, depending upon the particular installation in which the switch is used.

When the actuator 25 is pushed down as shown by the arrow 47 in FIG. 2, the switch arm 40 is caused to move down into its closed (ON) position against the force of the bow spring 46 for bringing the main contacts 44 and 32 together for completing a conductive path between the common terminal 18 and the ON terminal 22.

The ON contact 32 and the movable contact 4 are considered the "main" contacts of the switch 10, because the closure of these main contacts enables the electrical circuit 12, which is controlled by the switch 10 and which contains the equipment 14, to be energized by closure of an operating switch 30 (FIG. 7) which is included in the circuit 12.

The switch 10 includes operating means for moving its main contacts 44, 32 into the closed (ON) position and into the open (OFF) position. These switch operating means include the actuator 25 already described (plus the lever 23 if it is present) and the bowed sring 46 and also a movable link 48 to be described. This movable link 48 is formed of electrically conductive material having the lower of its ends hingedly seated at 4 to the inner portion 28 of the common terminal 18. For example, this hinged relationship at 49 is provided by receiving the end of the link 48 into a recess or slot in the fixed terminal portion 28. The upper end 50 of this movable link 48 is hingedly seated at 51 on the switch arm. For example, this hinged relationship at 51 is provided, as seen most clearly in FIGS. 4 and 5, by extending the link end 50 up through an opening 52 in the switch arm 40 for the edge of this opening to rest in a notch in the side of the link end 50. Thus, this hinged link 48 serves as a component of the switch operating means for it swings down with the switch arm about its fixed hinge location at 49, as seen in FIG. 2, when the switch arm 40 is moved down to closed (ON) position by depressing the actuator 25 as shown by the arrow 47. The bow spring 46 continues to exert an upward component of force on the switch arm 40, regardless of whether the switch arm is in its open (FIG. 1) or closed (FIG. 2) position.

Forming part of the operating means for the switch arm 40, there is a control leg 60 extending diagonally from the left (second) end of the movable switch arm 40. The foot end 58 of this diagonal control leg 60 is received loosely in a recess 62 at the lower left corner, of the housing 16. The purpose of this diagonal control leg 60 is to define and mechanically control the desired movement of the switch arm 40.

In FIG. 2, the switch arm 40 is shown in its normal closed (ON) position with the main contacts 44 and 32 firmly touching each other. As the actuator 25 is moved downwardly (arrow 47) in going from its initial outer position shown in FIG. 1 to its fully depressed position shown in FIG. 2, the foot end 58 initially moves down in its recess 62 until it touches the lower side of this recess at 64 as shown in FIG. 2. This abutting at 64 arrests the downward movement of the control leg 60 and thereby positively causes the right (first) end 42 of the switch arm to swing down for bringing the main contacts 44 and 32 together in firm contact as shown in FIG. 2.

In operation, during the downward motion 47 of the actuator 25, the foot end 58 moves down until it abuts against the housing wall at 64. Thereafter, this foot end acts like a fulcrum pivot at 64 for positively causing the first end 42 of the switch arm 40 to swing down firmly into the closed position, as shown in FIG. 2. The bow spring 46 plus the hinged link 48 produce a quick, toggle-like action. Consequently, after the fulcrum pivot has been established at 64 and after the first end 42 of the switch arm has begun to swing down and while the hinged link 48 is swinging down about its fixed pivot point at 49, the bow spring moves past its toggle position, and then the first end 42 of the switch arm swings down quickly with a snap-like action into its fully closed position, as shown in FIG. 2. The spring 46 continues to exert an upward component of force, but the main contacts are held firmly closed by the depressed 47 actuator 25.

Conversely, as the actuator 25 is allowed to move upwardly for turning OFF the switch 10, the foot end 58 initially rises being pushed upwardly as shown by arrow 56 (FIG. 3) by the upward component of bow spring force, until this foot end forms an abutting fulcrum at 66 (FIG. 3). While the link 48 is swinging upwardly about its fixed pivot point 49 and when the first end 42 of the switch arm begins to move upwardly, the bow spring 46 passes its toggle point, and the first end of the switch arm then quickly snaps up to its fully open position as shown in FIG. 1.

If sufficient current happens to be flowing through the electrical equipment 14 (FIG. 7), so that arcing occurs between the main contacts 32 and 44 as they are being separated when the switch is being turned OFF, then these main contacts may become fuses or welded together. If fusing occurs, the contact 44 will remain electrically connected to the ON contact 32 when the actuator 25 is in its released or open position as shown in FIG. 3.

Figure 4:
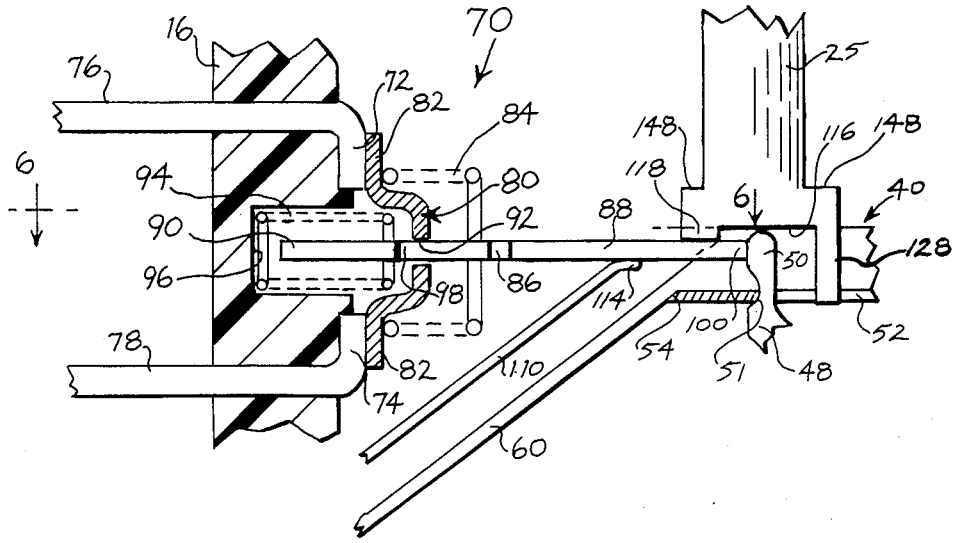
FIG. 4 is a further enlargement of a portion of FIG. 1 showing in greater detail how the auxiliary safety contact means are being held closed against the force of a cocked spring while the switch continues to operate in normal manner.

In order advantageously to disable or interrupt the electrical circuit 12 which is under control of the switch 10 in the event that its main contacts 44 and 32 remain together when the actuator 25 is released as shown by the arrow 56, auxiliary safety contact means, generally indicated at 70, are provided in the left end of the housing 16 near the second end 54 of the switch arm 40. The auxiliary safety contact means 70 include a pair of spaced auxiliary safety contacts 72 and 74 which extend toward each other and have respective external terminal portions 76 and 78. Positioned near these two contacts 72 and 74 is a movable conductive safety switch element 80 having a cup-shape with a flat circular flange 82 (FIGS. 4 and 5) for pressing flat against these contacts in good conductive relationship as seen in FIG. 4 for providing a highly conductive path through the switch element 8 bridging across between these contacts. This safety switch element 80 is normally in closed position; that is, engaging both contacts 72 and 74 so long as the main contacts 44, 32 do not become fused together as they are shown in FIG. 3.

A larger diameter coil spring 84 has one end pressing against the flange 82 for urging the switch element 80 toward closed position wherein it bridges across between its contacts 72, 74, as shown in FIGS. 1, 2 and 4. The other end of this coil spring 84 (FIG. 6) presses against a pair of shoulders 86 on a movable rigid insulating member 88 which serves to control the position of the switch element 80 by being operatively associated with the switch operating means, as will be explained later. This control member 88 has one of its ends 90 (FIG. 4, 5 and 6) inserted in loose-fitting relationship through an aperture 92 in the center of the switch element 80.

A smaller diameter coil spring 94 seating in a recess 96 in the switch housing presses against a pair of shoulders 98 on the control member 88 for continually urging or biasing the control member toward the right, namely, toward opening the auxiliary safety contact means 70. Thus, the second end 100 of this control member is normally being pushed toward the right by the bias spring 94, so that this end 100 thrusts against the upper end 50 of the hinged link 48. The control member 88 is normally prevented from moving toward the right under the bias force of the switch-opening spring 94, because its second end 100 is abutting against the upper end 50 of the link 48 which is acting as a mechanical stop having a fixed hinge point 49.

In addition to this switch-opening compression spring 94, there is a leaf spring 110 which serves as a trigger spring. This trigger spring has its second end 108 anchored in a socket 112, while its first end, 114 continually exerts an upward force on the control member 88, i.e. exerts a force in a direction generally transverse with respect to the length of said control member.

When the actuator 25 is depressed as shown by arrow 47 (FIG. 2) turning the switch ON, the control member 88 swings (tilts) downwardly as its second end 100 is pushed down by the actuator. Its first end 90 is sufficiently loosely received in the aperture in the switch element 80 for allowing this slight tilting movement of the control member without also tilting the switch element. Conversely, when the actuator is moved to OFF position, the control member 88 swings back up to a more nearly horizontal position as shown in FIGS. 1 and 4.

Thus, in this normal ON and OFF operation, the second end 100 of the control member 88 always remains abutting against the upper end 50 of the hinged link 48. The rightward thrust of the switch-opening spring 94, which causes a rightward thrust of the control member 88 against the end 50 of the hinged link 48 which, in turn, causes a rightward thrust of the hinged link 48, is ultimately resisted by the fixed pivot at 49.

In order to assure that the control member end 100 will remain normally abutting against the side surface of the hinged link end serving as stop 50, the switch actuator 25 has a special configuration on its lower portion. There is an elevated central clearance recess 116 (FIG. 4) defining a downwardly protruding leg 118 which normally holds the control member end 100 down below the upper extremity of the stop 50, where the control member end cannot normally slip past this stop.

In the event that the main contacts 44, 32 remain welded, fused, or stuck together as shown in FIG. 3 when the actuator 25 is allowed to move upwardly as indicated by arrow 56 for turning the switch OFF, then these joined-together contacts 44–32 prevent the first end 42 of the switch arm 40 from rising. The upward component of force exerted by bow spring 46 causes the second end 54 of the switch arm to swing up until the foot end 58 of the leg 60 abuts against the recess wall at 66 preventing further upward movement of the switch arm. That is, the upward motion of the switch arm 40 is now totally arrested at both of its ends, but the first end 114 of the trigger spring 110 continues to lift upwardly on the control member 88 as indicated by the curved arrow 120 (FIG. 5).

The switch operating means has assumed an abnormal position when the upward motion of the switch arm 40 is arrested at both ends while the actuator 25 is being moved as indicated by the arrow 56 toward the OFF position.

Figure 5:
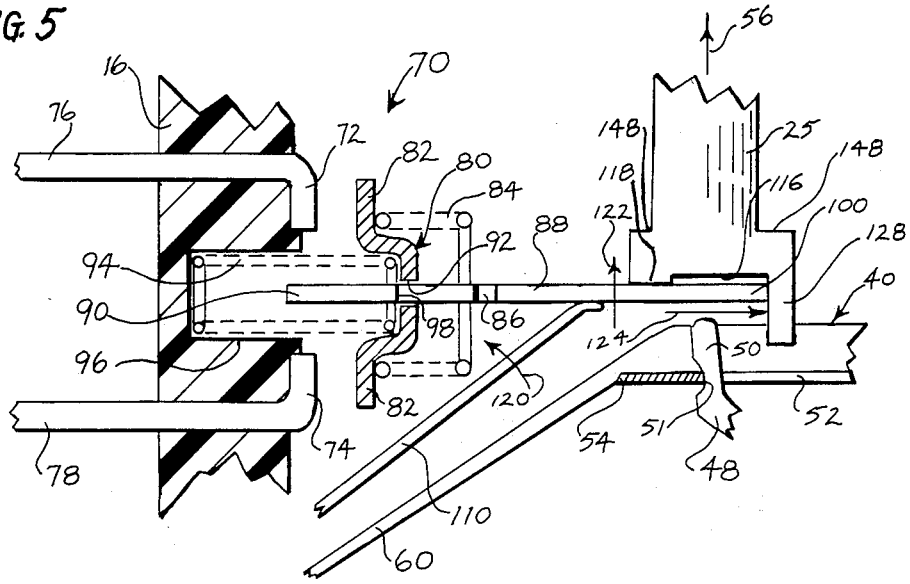
FIG. 5 is a further enlargement of a portion of FIG. 3 showing in greater detail how the auxiliary safety contact means are released so that the cocked spring can immediately move them into open relationship for interrupting a current flow path, when the switch operating means are moved to OFF position but the main switch contacts remain "welded" together in their ON position.
Figure 6:
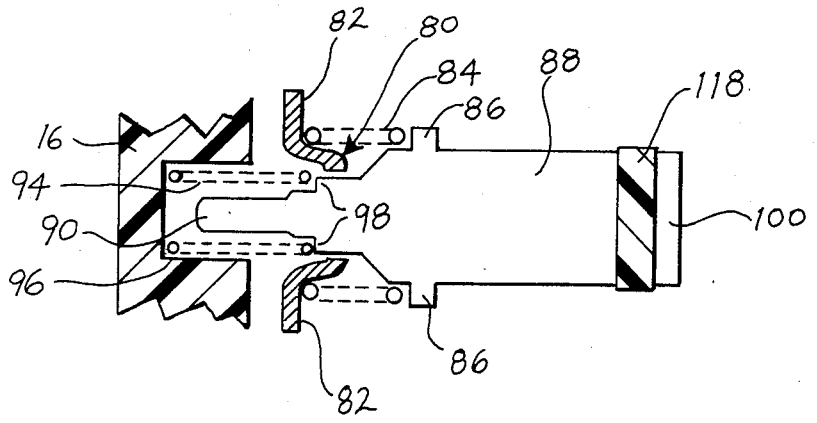
FIG. 6 is a partial sectional view taken along the line 6—6 in FIG. 4 showing further details of the auxiliary safety contacts and the member which normally holds them closed against the force of a stressed cocked spring.

As seen most clearly in FIG. 5, this trigger spring now causes the second end 100 of the control member 88 to be lifted as shown by arrow 122 above the stop end 50 of the link 48, thus immediately releasing the control member to move to the right as indicated by arrow 124, thus allowing the compressed spring 94 suddenly to lengthen to quickly move the switch element 80 into its open position. The circular shape of the end of the coil spring 94 does not fit through the slotted aperture 92, even though the strip-shaped control member 88 can slide freely through the aperture as seen in FIG. 5. Consequently, the spring 94 moves the switch element 80 to the right as seen in FIG. 5, and the conductive path between the auxiliary safety terminals 76 and 78 is interrupted.

In order to arrest the rightward movement 124 of the member 88, the lower portion of the actuator 25 has a second downwardly protruding leg 128 which is long enough to extend down into the opening 52 in the switch arm 40. The end 100 of the control member 88 is stopped by this leg 128.

The actuator 25 is made of rigid insulating material. The housing 16 is molded of durable rigid insulating plastic material in two mating parts. After the switch components have been assembled in the interior of the housing, its two mating parts are secured together by fastening means, for example, rivets or screws or bolts and nuts, which are inserted through appropriate mounting holes, for example, at 129 and 130.

As shown in FIG. 7, an advantageous way to connect the switch 10 into a circuit 12 is to include the auxiliary safety contact means 70 in series with the electrical equipment 14. One electrical supply line 132 (FIG. 7) from a power source (not shown), e.g., a 115 V, 60 Hz A.C. voltage source, is shown electrically connected to the common terminal 18. The operating switch 30 may be included in this supply line, if desired. The OFF terminal 24 is shown electrically connected to the other supply line 134 from the power source, e.g. through a lead 136 to a brake 138 and through a lead 140 to the supply line 134. Thus, the brake 138 is applied whenever the switch 10 is OFF. The ON terminal 22 is connected through a lead 142 to one of the safety terminals 76 or 78, and another lead 144 is connected from the other safety terminal to the equipment 14 being controlled, with a lead 146 from the equipment to the other supply line 134. Therefore, the auxiliary safety contact means are connected directly in series with the electrical load 14. Interrupting the conductive path between the terminals 76, 78 will immediately disable the circuit 12 so that the equipment will not become energized by closure of the operating switch 30. This operating switch may be included at any desired location in circuit in series with the electrical load 14. For example, this operating switch may be located at 30' in the lead 144 instead of being at 30 in the supply line 132.

The switch embodiment 10 of the present invention is described as including an OFF contact 34 and an OFF external terminal 24.

It is to be understood that the intended meaning of "OFF contact" is to be broadly construed to include either a conductive or a non-conductive element 34 against which a portion 45 of the first end 42 of the switch arm 40 comes to rest when the switch arm is in its normal OFF (open) position. For example, the OFF contact can be omitted entirely to be replaced by a non-conductive abutment or fixed post serving merely as a mechanical stop in the housing 16, and then the external OFF terminal 24 and the brake circuit 136, 138 and 140 are omitted. In other words, the described embodiment of the present invention solves the problem of main switch contacts 44, 32 becoming fused, welded or stuck together in their ON position, regardless of whether the OFF contact is conductive or non-conductive or omitted or non-existent or is present but not utilized in any external circuit. It is to be understood that the contact (or button element) 45 carried by the first end 42 of the switch arm 40 serves as a mechanical stop which abuts against an opposed element, such as a contact or stop 34 when the switch arm is moved to its normal OFF position, for limiting and defining the amount of upward travel of this first end of the switch arm when it is moved to its open (OFF) position as pushed upwardly by the spring means 46. The shoulders 148 on the actuator 25 normally serve as stop means for limiting the upward travel of the second end 54 of the switch arm.

An example of an application wherein the present invention may be used to advantage is a food processor. In such an example, the food processing tool 15 is driven by a motor drive 14. A removable cover 19 is located on a working bowl (not shown) in which the rotatable tool 15 processes various food items. The interlock mechanism 11 includes a vertical plunger 1 mounted in the working bowl with a spring urging this plunger upwardly away from the switch actuator 25 and includes an element on the cover 19 which depresses the plunger 21 for turning ON switch 10 only when the cover has been properly placed by the operator on the rim of the bowl in readiness for food processing operation. In a food processor, the plunger 21 is directly aligned with the actuator 25, and the lever 23 is omitted. The operator uses an operating switch 30 or 30' for running the motor drive 14 after the cover 19 has been appropriately placed on the bowl. When the cover 19 is removed by the operator from the bowl, the plunger 21 moves upwardly for turning OFF the interlock switch 10, and thus closure of the operating switch 30 or 30' can not energize the motor drive 14 until the cover 19 is again placed on the bowl in readiness for further food processing operation. In the event that the main contacts 44, 32 in the interlock switch 10 happen to become welded, fused or stuck together, then the auxiliary safety contact means 70, which are connected in the circuit 142, 144, 146 in series with the motor drive 14, are automatically triggered and moved into open position for interrupting this energizing circuit. This opening of the auxiliary safety contact means 70 prevents further operation of the motor drive until the food processor appliance has been serviced by replacing the malfunctional interlock switch 10 with a new switch.

It is to be understood that physical orientation terms, such as "horizontal", "up", "upper", "upward", "upwardly", "rises", "above", "down", "downward", "downwardly", "lower", "below", "right", "rightward", "left", and similar terms, are set forth for convenience of the reader in readily understanding the description with reference to the drawings as shown and these terms are not intended to be limiting. The switch 10 can be installed and mounted (and will operate properly) in any desired orientation, because the various components are operated by mechanical motions and by spring forces without any significant effect by the earth's gravity.

It is to be understood by those skilled in the art that various modifications may be made in the described embodiment of the present invention, without departing from the spirit and scope of the present invention, as described in the specification and defined in the appended claims.

I claim:

1. A safety switch having a housing containing a first main contact, a second main contact carried by a movable switch arm and switch operating means being actuatable for moving said movable arm to an ON position in which said second main contact touches said first main contact and said switch operating means being actuatable for moving said switch arm to an OFF position in which said second main contact is separated from said first main contact, said safety switch comprising:

a safety contact within said switch housing, a movable conductive safety switch element in said housing movable against said safety contact for completing a conductive path through said safety contact and said safety switch element and being movable away from said safety contact for interrupting said conductive path, bias spring means in said housing operatively associated with said safety switch element for urging said safety switch element away from said safety contact, control means within said housing interposed between said switch operating means and said safety switch element normally holding said safety switch element against said safety contact in spite of the urging of said bias spring means, said control means becoming immediately released from holding said safety switch element against said safety contact if said switch operating means is actuated for moving said switch arm to its OFF position but said second main contact does not separate from the first main contact, and said bias spring means immediately moving said safety switch element away from said safety contact upon said control means becoming released for immediately interrupting said conductive path through said safety contact and said safety switch element.

2. A safety switch as claimed in claim 1, in which:

said bias spring means is a first spring, a second spring in said housing urges said safety switch element against said safety contact, said second spring is interposed between said control means and said safety switch element, said control means normally holds said second spring in a first position to overcome said bias spring means for causing said second spring to hold said safety switch element against said safety contact and said control means, and said control means releases said second spring to move to a second position for releasing said bias spring means for moving said safety switch element away from said safety contact for interrupting said conductive path if said operating means is actuated for moving said switch arm to its OFF position, but said second main contact does not separate from said first main contact.

3. A safety switch as claimed in claim 2, in which:

said control means in said housing holds said second spring in said first position urging said safety switch element against said safety contact, and said control means moves said second spring to said second position relieving said safety switch element from the closing force of said second spring simultaneously with releasing said bias spring means for moving said safety switch element away from said safety contact if the main contacts remain closed when the switch is actuated for opening the main contacts.

4. A safety switch having a housing wherein main contacts are closed by actuator means for completing a circuit and are opened by said actuator means for interrupting the circuit for use in association with electrical equipment wherein said switch is to be connected in a circuit with the equipment, and the actuator means are intended to cause the main contacts of the switch to be opened for disabling operation of the equipment whenever an operator moves a barrier protecting a portion of the equipment, said safety switch comprising:

auxiliary contacts located within the switch housing, a first pre-stressed spring in said housing associated with said auxiliary contacts continuously urging said auxiliary contacts toward an open position, control means in said housing interposed between said actuator means and said auxiliary contacts for normally overcoming said pre-stressed spring for holding said auxiliary contacts closed, said control means being released within the switch housing for allowing said pre-stressed spring immediately to open said auxiliary contacts if the main contacts remain closed when the actuator means are operated for opening the main contacts, a pair of auxiliary terminals external of the switch housing and being electrically coupled to said auxiliary contacts within the switch housing, said auxiliary contacts completing a current flow path between said pair of external auxiliary terminals when said auxiliary contacts are closed, said auxiliary contacts interrupting said current flow path when said auxiliary contacts are opened, and said external auxiliary terminals are adapted to be connected in series with said circuit for interrupting the circuit for preventing operation of the equipment, if the main contacts of the switch remain closed when the operator moves said barrier.

5. A safety switch as claimed in claim 4, in which:

a second spring in said housing urges said auxiliary contacts toward closed position, said second spring is interposed between said control means and said auxiliary contacts, said control means normally holds said second spring in a first position for causing said second spring to overcome said pre-stressed spring for holding said auxiliary contacts closed, and said control means releases said second spring to move to a second position for allowing said pre-stressed spring to open said auxiliary contacts for interrupting said current flow path if said actuator means is actuated for opening said main contacts, but said main contacts do not open.

6. A switch for automatically interrupting a circuit when a pair of contacts weld together, comprising:

a switch housing including the pair of contacts, said pair of contacts being main contacts, one being fixed in the housing and the other of said main contacts being movable, a movable switch arm in said housing carrying said movable contact, spring means mechanically coupled to said switch arm for normally biasing said movable contact away from said fixed contact, actuator means movable in a first direction for overcoming the biasing force of said spring means for moving said movable contact into engagement With said fixed contact, said actuator means being movable in a second direction for allowing said spring means to move said switch arm for separating the movable contact from the fixed contact, auxiliary contact means within the housing, a pair of auxiliary terminals external of the housing electrically connected to said auxiliary contact means, said external auxiliary terminals being adapted to be connected in the circuit to be interrupted, control means within the housing for normally causing said auxiliary contact means to be closed for completing a conductive path between said external auxiliary terminals, and said control means causing said auxiliary contact means to open for interrupting the conductive path between said external auxiliary terminals if the actuator means is moved in said second direction but said main switch contacts do not separate.

7. A switch for automatically interrupting a circuit when a pair of contacts weld together as claimed in claim 6, in which said control means include:

first spring means in the housing for normally holding said auxiliary contact means closed for completing the conductive path between said external auxiliary terminals, second spring means in the housing for opening said auxiliary contact means for interrupting said conductive path, and restraining means in the housing normally restraining said second spring means for causing said first spring means to hold said auxiliary contacts closed, said restraining means releasing said second spring means for opening said auxiliary contact means if the main contacts do not separate when the actuator means is moved in said second direction.

8. An electrical switch for automatically interrupting a conductive path between a pair of external auxiliary terminals when a movable contact welds to another contact in the closed position wherein a movable member in a switch housing carries the movable contact, said member being movable between an open and a closed position in response to operation of an actuator and in which the movable contact normally releasably engages the other contact in the closed position and is separated from the other contact in the open position comprising:

a pair of external auxiliary terminals on the switch housing, auxiliary contact means within the housing electrically connected to said external auxiliary terminals, said auxiliary contact means normally being closed for completing a conductive path between said external auxiliary terminals, said auxiliary contact means being openable for interrupting the conductive path between said external auxiliary terminals, said movable member capable of assuming an abnormal position when the movable contact does not separate from the other contact and the actuator is operated to move said movable member to the open position, and control means in the switch housing responsive to the abnormal position of said movable member for opening said auxiliary contact means.

9. A safety switch as claimed in claim 8, wherein said control means within the switch housing for opening said auxiliary contact means comprise:

a first spring in the housing normally urging said auxiliary contact means closed, a second spring in the housing stressed in a direction for opening said auxiliary contact means, and restraining means in the housing normally restraining said second spring for causing said first spring to hold said auxiliary contact means closed, said restraining means being released for allowing said second spring to open said, auxiliary contact means when said member assumes said abnormal position.

10. A switch for automatically interrupting a circuit when a pair of contacts weld together, comprising:

a switch housing including the pair of contacts, said pair of contacts being main contacts, one being fixed in the housing and the other of said main contacts being movable, a movable switch arm in said housing carrying said movable contact, first spring means mechanically coupled to said switch arm normally acting to hold said switch arm in a first position for keeping said movable contact away from said fixed contact, actuator means movable in a first direction overcoming the action of said first spring means for moving said switch arm from said first position to a second position for bringing said movable contact into engagement with said fixed contact, said actuator means being movable in a second direction opposite to said first direction for allowing the action of said first spring means to move said switch arm from said second position back to said first position for separating the movable contact from the fixed contact, auxiliary contact means within the housing movable between closed and open positions, second spring means stressed within the housing operatively associated with said auxiliary contact means and continuously exerting force for urging said auxiliary contact means from said closed position to said open position, a control member normally in interposed position between said actuator means and said auxiliary contact means, said control member acting against the force of said stressed second spring means for normally keeping said auxiliary contact means in said closed position, said control member becoming immediately released from said interposed position if said actuator means is moved in said second direction but said movable contact is welded to said fixed contact preventing said first spring means from moving said switch arm back to said first position for immediately releasing said stressed second spring immediately to move said auxiliary contact means from said closed to said open position thereby interrupting any circuit through said auxiliary contact means.

11. A switch for automatically interrupting a circuit when a pair of contacts weld together as claimed in claim 10, in which:

said switch housing has a common terminal external of said housing, said common terminal being electrically connected to said switch arm, said switch arm being electrically conductive, and said auxiliary contact means being in circuit in series with said fixed contact, said movable contact, said switch arm and said common terminal when said switch arm is in said second position with said movable contact in engagement with said fixed contact.

* * * * *